US005626189A

United States Patent [19]

Hutchinson

[11] Patent Number: 5,626,189

[45] Date of Patent: May 6, 1997

[54] WELLBORE MILLING TOOLS AND INSERTS

[75] Inventor: Christopher P. Hutchinson, Houston, Tex.

[73] Assignee: Weatherford U.S., Inc., Houston, Tex.

[21] Appl. No.: 532,474

[22] Filed: Sep. 22, 1995

[51] Int. Cl.[6] ..... E21B 10/46

[52] U.S. Cl. ..... 166/55.6; 175/426; 407/116

[58] Field of Search ..... 166/55.6; 175/426; 407/113, 114, 115, 116

[56] References Cited

U.S. PATENT DOCUMENTS

| | | | |
|---|---|---|---|
| Re. 30,908 | 4/1982 | Friedline | 407/114 |
| D. 298,633 | 11/1988 | Kenemore | D15/139 |
| D. 317,010 | 5/1991 | Knemeyer | D15/21 |
| D. 330,206 | 10/1992 | Slutz | D15/139 |
| 1,522,593 | 1/1925 | Pickin . | |
| 1,681,675 | 8/1928 | Miller . | |
| 2,328,494 | 8/1943 | Reaney | 29/105 |
| 2,333,653 | 11/1943 | Kraus | 407/55 |
| 2,370,273 | 2/1945 | Ulliman | 407/55 |
| 2,975,507 | 3/1961 | Wilder | 29/105 |
| 3,188,717 | 6/1965 | Heinlein | 29/96 |
| 3,381,349 | 5/1968 | Newcomer | 29/96 |
| 3,636,602 | 1/1972 | Owen | 29/95 |
| 3,701,187 | 10/1972 | Erkfritz | 29/95 |
| 3,875,631 | 4/1975 | Malinchak | 29/95 R |
| 3,947,937 | 4/1976 | Hertel | 29/95 R |
| 4,068,976 | 1/1978 | Friedline | 407/114 |
| 4,086,016 | 4/1978 | Goeke | 407/114 |
| 4,119,151 | 10/1978 | Smith | 166/298 |
| 4,140,431 | 2/1979 | Friedline et al. | 407/114 |
| 4,278,369 | 7/1981 | Jakobs et al. | 407/113 |
| 4,335,984 | 6/1982 | Zweekly | 407/114 |
| 4,340,325 | 7/1982 | Gowanlock | 407/116 |
| 4,449,864 | 5/1984 | Haque et al. | 407/113 |
| 4,472,093 | 9/1984 | Hamilton | 407/41 |
| 4,531,864 | 7/1985 | Bylund | 407/114 |
| 4,552,492 | 11/1985 | Komanduri et al. | 407/114 |
| 4,583,431 | 4/1986 | Komanduri et al. | 82/1 C |
| 4,588,332 | 5/1986 | Komanduri et al. | 407/114 |
| 4,593,777 | 6/1986 | Barr | 175/379 |
| 4,606,678 | 8/1986 | Zweekly | 407/114 |
| 4,618,009 | 10/1986 | Carter et al. | 175/267 |
| 4,629,371 | 12/1986 | Maeda et al. | 407/114 |
| 4,629,372 | 12/1986 | Huston | 407/116 |
| 4,655,648 | 4/1987 | Hellbergh | 407/42 |
| 4,705,434 | 11/1987 | Patterson et al. | 407/114 |
| 4,717,290 | 1/1988 | Reynolds et al. | 407/34 |

(List continued on next page.)

FOREIGN PATENT DOCUMENTS

| | | |
|---|---|---|
| 2431897 | 2/1980 | France . |
| 1070898 | 12/1959 | Germany . |
| 1579639 | 7/1990 | U.S.S.R. . |

OTHER PUBLICATIONS

"High Efficiency Metal Cutting Inserts," General Electric, p. 24; 1979.

"Turning Tools and Inserts," Sandvik Coromant, pp. 6, 34, 43, 46; 1984.

"NewsLine," Iscar, Ltd., pp. 3, 6, 9, 57, 58, 63, 66, 69, 70, 71; 1993.

"Kennametal Tooling Applications Program," Kennametal, Inc.; pp. 9, 52, 53, 54, 55.

"Quick Reference Catalog," Sandvik Coromant, pp. 2–6; 1994.

"Cut Grip Specials," Iscar, Ltd.; 1993.

*Primary Examiner*—Hoang C. Dang
*Attorney, Agent, or Firm*—Guy McClung

[57] ABSTRACT

A cutting insert for wellbore milling operations is disclosed which, in certain embodiments, has two or more top milling surfaces on an insert body with the surfaces at different heights above a bottom of the insert body. In certain embodiments three top surfaces are used stair-stepped, with a central lower surface, or with a central higher surface. In one aspect all cutting surfaces have an array of chipbreaking indentations. Tools and methods are disclosed which use such inserts.

6 Claims, 6 Drawing Sheets

U.S. PATENT DOCUMENTS

| | | | |
|---|---|---|---|
| 4,796,709 | 1/1989 | Lynde et al. | 166/55.6 |
| 4,844,643 | 7/1989 | Icks | 407/42 |
| 4,854,785 | 8/1989 | Lowe et al. | 407/115 |
| 4,872,520 | 10/1989 | Nelson | 175/430 |
| 4,887,668 | 12/1989 | Lynde et al. | 166/55.8 |
| 4,934,879 | 6/1990 | VanBarneveld | 407/66 |
| 4,938,291 | 7/1990 | Lynde et al. | 166/55.8 |
| 4,946,318 | 8/1990 | David et al. | 407/42 |
| 4,969,779 | 11/1990 | Barten | 407/114 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,028,175 | 7/1991 | Pawlik | 407/40 |
| 5,038,859 | 8/1991 | Lynde et al. | 166/55.6 |
| 5,044,840 | 9/1991 | Fouquer et al. | 407/114 |
| 5,058,666 | 10/1991 | Lynde et al. | 166/55.6 |
| 5,059,069 | 10/1991 | Lagerberg | 407/113 |
| 5,070,952 | 12/1991 | Neff | 175/426 |
| 5,076,739 | 12/1991 | Pano | 407/116 |
| 5,078,550 | 1/1992 | Satran et al. | 407/34 |
| 5,085,542 | 2/1992 | Nakayama et al. | 407/114 |
| 5,086,838 | 2/1992 | Cassel et al. | 166/55.6 |
| 5,112,162 | 5/1992 | Hartford et al. | 407/49 |
| 5,137,396 | 8/1992 | Durschinger | 407/116 X |
| 5,150,755 | 9/1992 | Cassel et al. | 166/297 |
| 5,158,401 | 10/1992 | Pawlik | 407/40 |
| 5,158,402 | 10/1992 | Satran et al. | 407/113 |
| 5,180,258 | 1/1993 | Bernadic | 407/114 |
| 5,181,564 | 1/1993 | Lindley et al. | 166/55.6 |
| 5,199,513 | 4/1993 | Stewart et al. | 175/73 |
| 5,209,611 | 5/1993 | Drescher | 407/114 X |
| 5,221,164 | 6/1993 | Allaire | 407/175 |
| 5,253,710 | 10/1993 | Carter et al. | 166/298 |
| 5,297,630 | 3/1994 | Lynde et al. | 166/297 |
| 5,318,115 | 6/1994 | Rouse | 166/55.7 |
| 5,341,873 | 8/1994 | Carter et al. | 166/117.5 |
| 5,373,900 | 12/1994 | Lynde et al. | 166/297 |
| 5,409,060 | 4/1995 | Carter | 166/237 |
| 5,425,417 | 6/1995 | Carter | 166/117.6 |
| 5,429,187 | 7/1995 | Beagrie et al. | 166/55.1 |
| 5,449,255 | 9/1995 | Katbi et al. | 407/114 |
| 5,452,759 | 9/1995 | Carter et al. | 166/117.6 |
| 5,456,312 | 10/1995 | Lynde et al. | 166/55.6 |

FIG. 2F
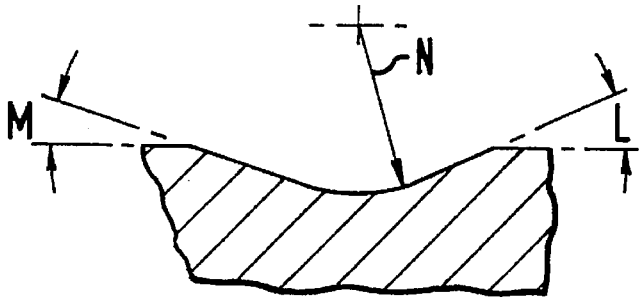
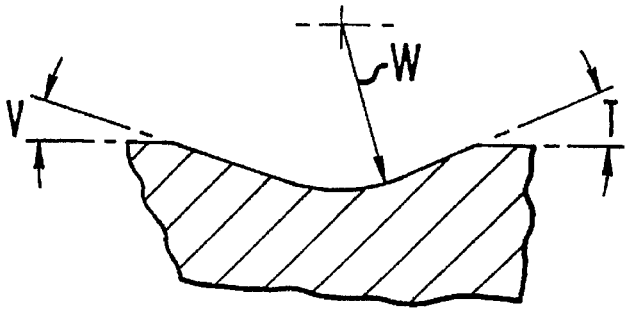
FIG. 2G
FIG. 2H
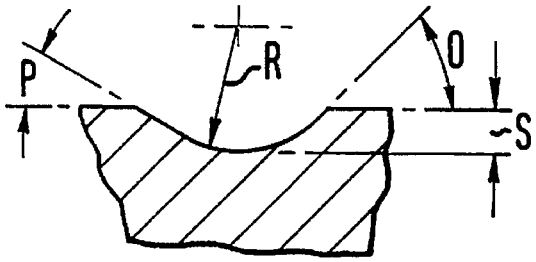
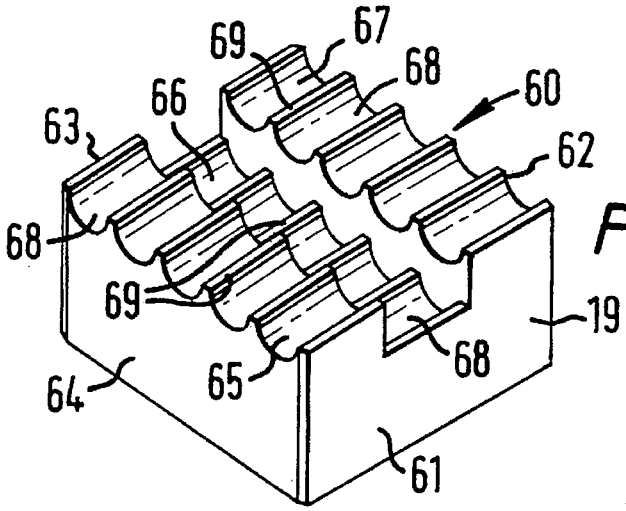
FIG. 3A
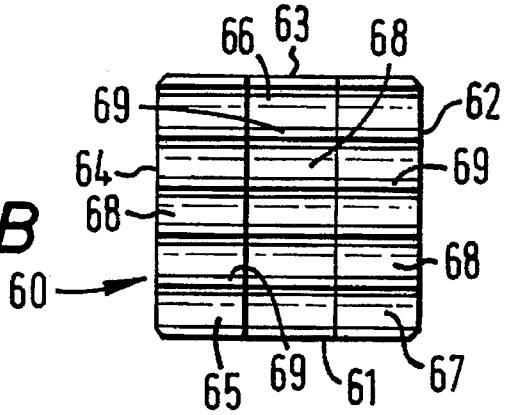
FIG. 3B FIG. 5A
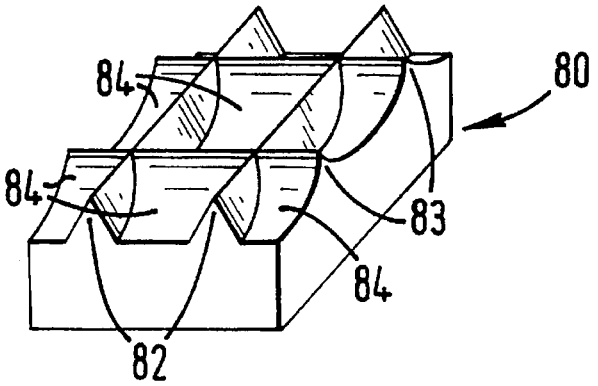
FIG. 5B
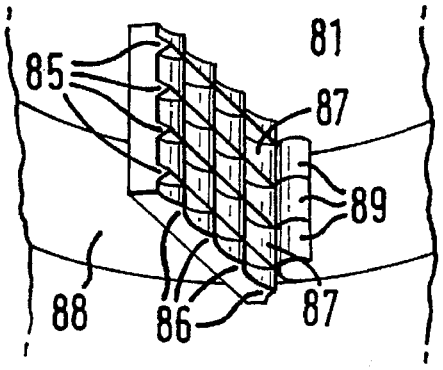
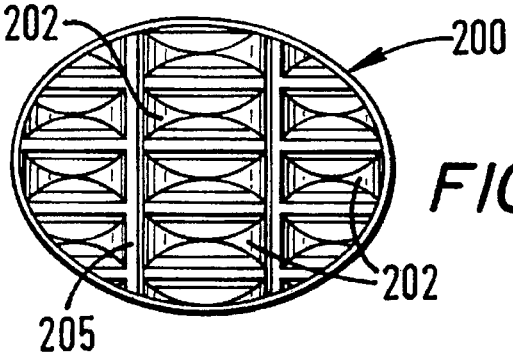
FIG. 8
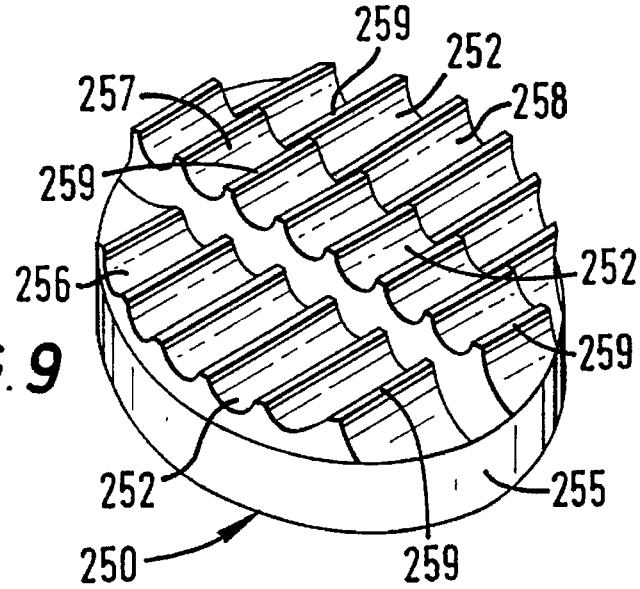
FIG. 9

WELLBORE MILLING TOOLS AND INSERTS

BACKGROUND OF THE INVENTION

1. Field of the Invention

This invention is related to wellbore milling processes, wellbore milling tools, and cutting inserts for such tools.

2. Description of Related Art

Milling tools are used to cut out windows or pockets from a tubular, e.g. for directional drilling and sidetracking; and to mill out for removal materials downhole in a wellbore, such as pipe, casing, casing liners, tubing, or jammed tools (a "fish"). The prior art discloses various types of milling or cutting tools provided for milling out a fish or for cutting or milling existing pipe or casing previously installed in a well. These tools have cutting blades or surfaces and are lowered into the well or casing and then rotated in a milling/cutting operation. With certain tools, a suitable drilling fluid is pumped down a central bore of a tool for discharge beneath the cutting blades or surfaces and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like.

The prior art discloses a variety of cutting inserts for wellbore milling tools. Certain of these inserts have a surface irregularity, recess, or indentation that serves as a chipbreaker to break a cutting being produced by an insert to limit the length of the cuttings. Certain prior art inserts have multiple chipbreakers on a single insert.

There has long been a need for an efficient and effective milling method in which the size of milled cuttings is controlled and optimized. There has long been a need for a cutting insert for wellbore milling tools which produces cuttings or chips at a desired rate and of a desired size. There has long been a need for tools with such inserts. There has long been a need for milling methods using such tools and such inserts.

SUMMARY OF THE PRESENT INVENTION

The present invention, in one embodiment, discloses a multi-level cutting insert for wellbore milling operations. In certain embodiments such an insert has a body with a plurality of cutting surfaces at different heights on the body. In one aspect the surfaces are stair-stepped from left-to-right or right-to-left, and there are two, three, or more cutting surfaces, and planes in which the surfaces are disposed are parallel or, in other embodiments, are not parallel. In another aspect a lower cutting surface is positioned between two higher cutting surfaces, and planes in which the surfaces are disposed are parallel or, in other embodiments, are not parallel. The higher cutting surfaces may be at the same or different heights. In another aspect, a higher cutting surface is positioned between two lower cutting surfaces, and planes in which the surfaces are disposed are parallel or, in other embodiments, are not parallel. The lower cutting surfaces may be at the same or different heights. Any cutting surface of any of the above-described inserts may have one or more chipbreakers (irregularity, recess, indentation) for limiting the length of cuttings. By providing cutting surfaces at different heights, cuttings are sheared into multiple streams; i.e., rather than producing a single relatively wide cutting, the insert produces narrower cuttings, one for each cutting surface. In certain embodiments the body of the insert is, as viewed from above or below, generally circular, square, oval, rectangular, or triangular in shape.

In certain preferred embodiments of inserts according to this invention, insert height is limited to maintain insert strength. For example, in one embodiment a lowest cutting surface is at a height of no lower than about three sixteenths of an inch. In another aspect, an insert's height does not exceed about one-fourth of an inch.

In certain embodiments a multi-level insert according to this invention has no chipbreakers. In other embodiments a plurality of chipbreakers are so sized and so positioned on a multi-level insert that two (or more) cutting surfaces at angles to each other each produce a cutting stream and the cutting produced are limited in length by the chipbreakers. In one particular embodiment such a chipbreaker has an indented circular or oval shape (as viewed from above). In certain embodiments a patterned array of chipbreakers are employed covering an entire surface of the insert.

Inserts as described herein may be used on the various types of mills used in wellbore operations to mill out a fish or to produce a milled window or hole in a tubular such as casing or tubing.

In certain embodiments the present invention discloses a cutting insert for a tool for wellbore milling operations, the cutting insert having a body having a base, and a plurality of cutting surfaces on the body, at least one of the cutting surfaces at a different height above the base than the other cutting surfaces, each cutting surface defined by linear boundaries extending from a first edge of the cutting insert to a second edge of the cutting insert, and the linear boundaries parallel to each other as viewed from above; such an insert with a plurality of chipbreaking indentations on each cutting surface; such an insert wherein the plurality of cutting surfaces is three cutting surfaces including a first side cutting surface, a second middle cutting surface, and a third side cutting surface with the second middle cutting surface disposed between the first side cutting surface and the third side cutting surface; and such an insert wherein the body has a rectangular base and a raised portion extending above the rectangular base and the cutting surfaces are on a top of the raised portion. The present invention also discloses a tool for wellbore milling operations having a mill body; at least one milling surface on the mill body; a plurality of cutting inserts secured to the at least one milling surface of the mill body; the cutting inserts each comprising a body having a base, and a plurality of cutting surfaces on the body, at least one of the cutting surfaces at a different height above the base than the other cutting surfaces, each cutting surface defined by linear boundaries extending from a first edge of the cutting insert to a second edge of the cutting insert, and the linear boundaries parallel to each other as viewed from above; and such a tool with a plurality of chipbreaking indentations on each cutting surface, and wherein the plurality of chipbreaking indentations is a patterned array of rows and columns of indentations covering the entire cutting surfaces.

It is, therefore, an object of at least certain preferred embodiments of the present invention to provide:

New, useful, unique, efficient, non-obvious inserts for wellbore milling tools, tools with such inserts, and methods for milling operations using such tools and such inserts;

Such an insert with multi-level cutting surfaces;

Such an insert with a plurality of chipbreakers; in one aspect chipbreakers with a circular or oval shape as viewed from above; in one aspect an array of such chipbreakers substantially covering the milling surface of an insert;

Such an insert with plural cutting surfaces at angles to each other;

A milling tool with such an insert; and

Methods for using such inserts and such tools in wellbore milling operations.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 2F is a cross-sectional view of a chipbreaker in a central portion of the insert as shown in FIG. 2D; FIG. 2G is a cross-sectional view of a chipbreaker in a side portion of the insert as shown in FIG. 2D; and FIG. 2H is a cross-sectional view along line 2H—2H of FIG. 2E.

FIG. 3A is a perspective view of an insert for wellbore milling according to the present invention; FIG. 3B is a top view of the insert of FIG. 3A.

FIG. 5A is a perspective view of a milling insert.

FIG. 5B is a perspective view of a milling insert shown producing multiple cuttings from a casing.

FIG. 8 shows a wellbore milling tool with inserts according to the present invention.

FIG. 9 shows a wellbore milling tool with inserts according to the present invention.

DESCRIPTION OF EMBODIMENTS PREFERRED AT THE TIME OF FILING FOR THIS PATENT

Figure 1A:
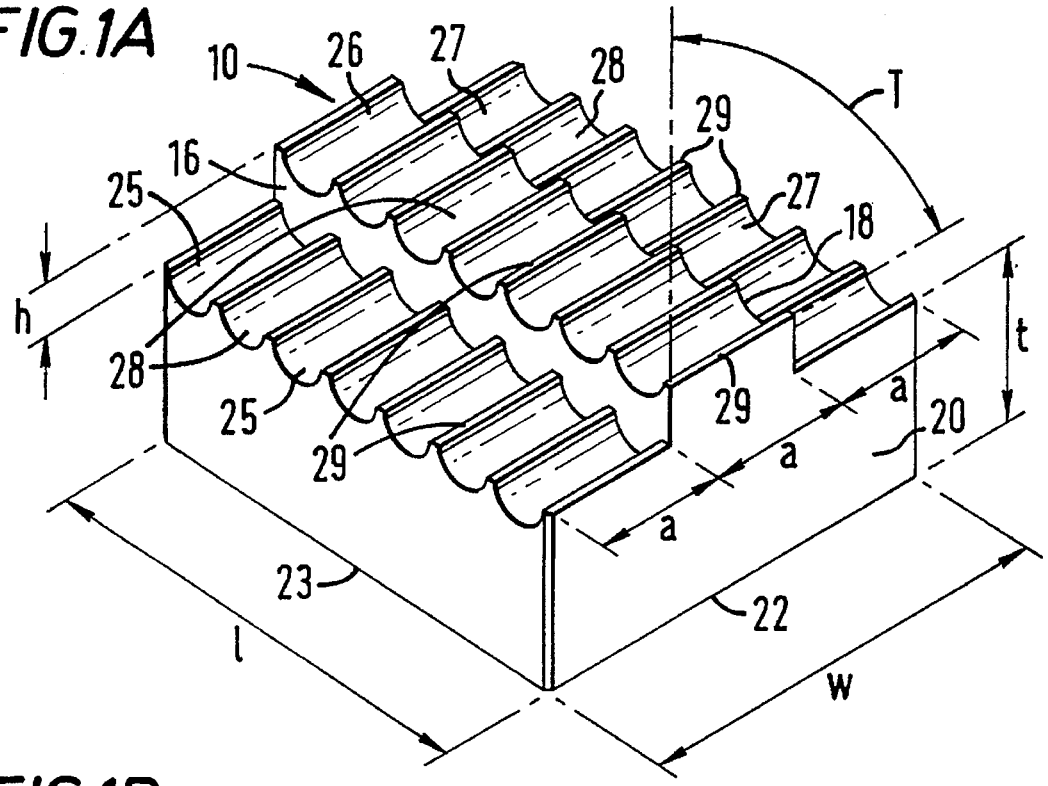
FIG. 1A is a perspective view of a wellbore milling insert according to the present invention.
Figure 1B:
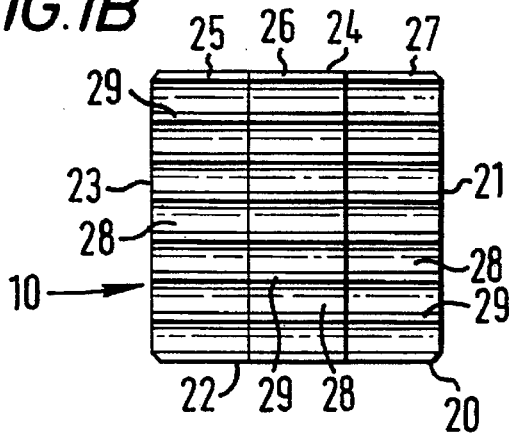
FIG. 1B is a top view of the insert of FIG. 1A.

Referring now to FIGS. 1A–1F, an insert 10 according to the present invention has a body 20 with four sides 21, 22, 23, 24. The body 20 is shown as square, but it may be rectangular, circular, oval, triangular or any desired shape. A top surface of the body 20 has three milling surfaces 25, 26, and 27. The surfaces 25 and 27 have a height t as shown in FIG. 1A. The surface 26 (disposed between the surfaces 25 and 27) has a height t+h as shown in FIG. 1A. Each top surface 25, 26, 27 has a plurality of chipbreaker indentations 28 formed therein with a ridge 29 between chipbreakers. As viewed from the side the side 21 is like the side 23.

The body 20 has a width w and a length l (equal to each other in the square embodiment of FIG. 1A). Each of the top surfaces 25, 26, 27 has a width a, three times which equals the width w. Sides 16 and 18 of the middle top surface 26 extend upwardly from the lower surfaces 25 and 27. It is within the scope of this invention for the three surfaces to have different widths or for any two of the surfaces to have the same width (either less than or greater than the third surface's width).

In certain preferred embodiments t+h ranges between about 3/16" and about 1/4"; and h ranges between about 0.03" and about 0.09". In one embodiment l and w are about 0.5"; t is about 0.187"; a is about 0.166"; and h is about 0.06". T is the angle between the surface of the ridges 29 and the sides of the top surface 26. In certain preferred embodiments T is ninety degrees or between eighty and ninety degrees. In certain preferred embodiments of such inserts, or tools with such inserts, cuttings are produced which range in thickness between about 0.015" and about 0.025", in length between about 0.5" and about 1.5"; and in width between about 0.125" and about 0.170". In one embodiment cuttings about 0.015" thick, about 0.170" wide, and about 1.5" long are produced.

Figure 1C:
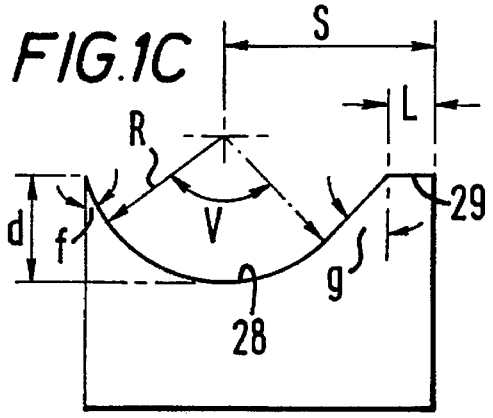
FIG. 1C is a partial side view of the insert of FIG. 1A.
Figure 1D:
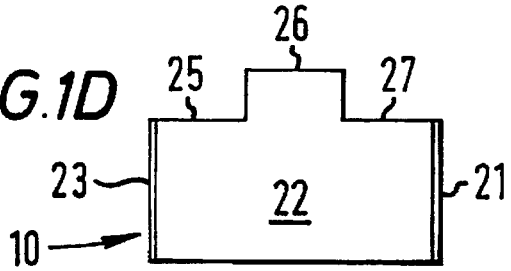
FIG. 1D is a front view of the insert of FIG. 1A.
Figure 1E:
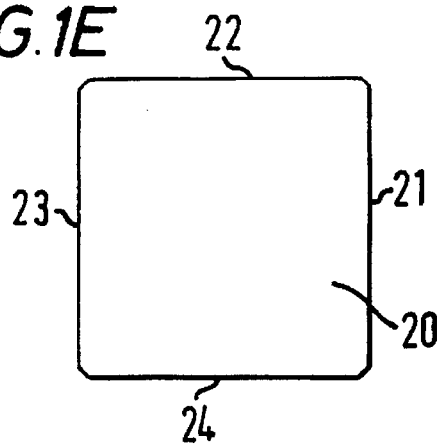
FIG. 1E is a bottom view of the insert of FIG. 1A.
Figure 1F:
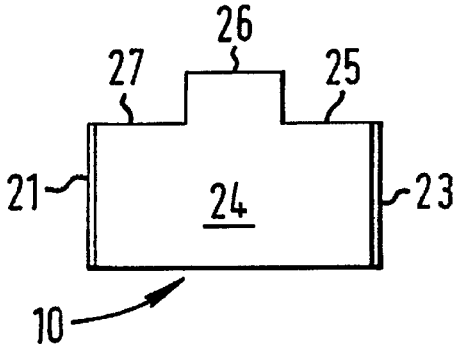
FIG. 1F is a rear view of the insert of FIG. 1A.

FIG. 1C shows one of the chipbreaker indentations 28 and ridges 29. S is a distance from an edge of the ridge 29 to a center of the indentation 28. L is the width of the ridge 29. d is the depth of the indentation 28. f is an angle between a portion of the indentation 28 and a vertical line drawn from an edge of a ridge 29 (not shown in FIG. 1C). g is an angle between a portion of the indentation 28 and a vertical line drawn through the inner edge of the ridge 29 (FIG. 1C). R is a radius of curvature of the angle V. V is an angle between ninety and one hundred and ten degrees.

In one preferred embodiment L ranges between 0.005" and 0.015". In one particular embodiment L is 0.01"; V is 102 degrees; f is 33 degrees; g is 45 degrees; R is 0.03"; S is 0.044"; and d is 0.022".

Figure 2A:
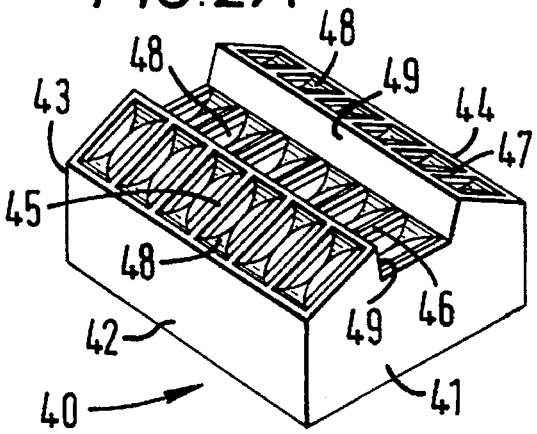
FIG. 2A is a perspective view of a wellbore milling insert according to the present invention.
Figure 2C:
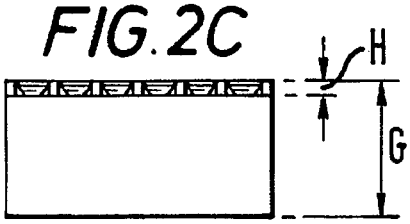
FIG. 2C is a side view of the insert of FIG. 2B.
Figure 2D:
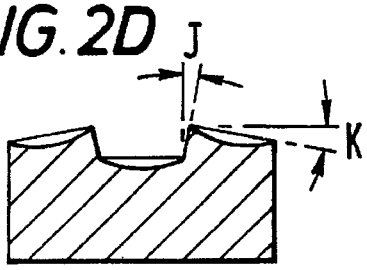
FIG. 2D is a cross-sectional view along line 2D—2D of FIG. 2B.

FIG. 2A shows an insert 40 according to the present invention which has a body 49; four sides 41, 42, 43, 44; top milling surfaces 45, 46, and 47; and a plurality of chipbreaking indentations 48. Angled interior side walls 49 in middle of the insert 40 extend from one of the side upper surfaces down to the lower middle surface 46.

In certain embodiments of the insert 40 (FIGS. 2A–2H) the labelled features have the following preferred dimensional ranges:

A ⅜" to ½"
B 0.25" to 0.335"
C 0.125" to 0.167"
D 3/16" to ¾"
E 0.06" to 0.115"
F 0.005" to 0.020"
G 3/16" to ¼
H 0.030" to 0.090"
K 0° to 10°
L 0° to 45°
M 0° to 45°
N 0" to 0.2"
P 0° to 45°
Q 25° to 45°
R 0.02" to 0.04"
S 0° to 45°
T 0° to 45°
V 0° to 45°
W 0" to 0.2"

Letters N, W, R, in FIGS. 2F, 2G, 2H, respectively indicate radii of chipbreaking recesses.

As shown in FIG. 2A the insert 40 has the three cutting surfaces 45, 46, and 47 which are defined by linear boundaries running from one edge of the insert to another edge of the insert. The cutting surfaces each lie in a plane and the planes as shown are not coincident. The planes of the outside cutting surfaces 45 and 47 are at angle to the plane of the middle cutting surface 46 which is greater than 180°. The streams of cuttings produced by the two outside cutting surfaces 45 and 47 will diverge from the cuttings stream produced by the middle cutting surface 46. In another embodiment the angle of the outside planes with respect to the middle plane is less than 180° and the streams of cuttings produced by the outside cutting surfaces will converge on and be directed toward the cuttings stream produced by the middle cutting surface. It is within the scope of this invention to provide an insert with only two cutting surfaces (e.g. any two of the cutting surfaces of any insert shown or described herein).

Figure 3C:
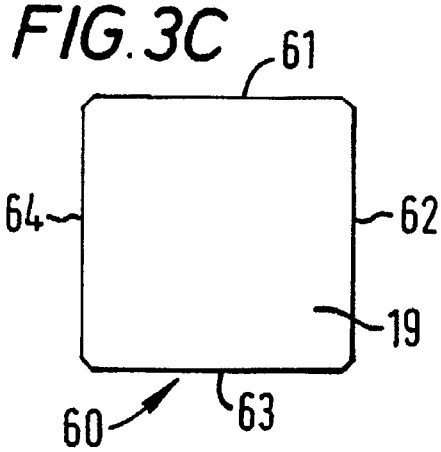
FIG. 3C is a bottom view of the insert of FIG. 3A.
Figure 3D:
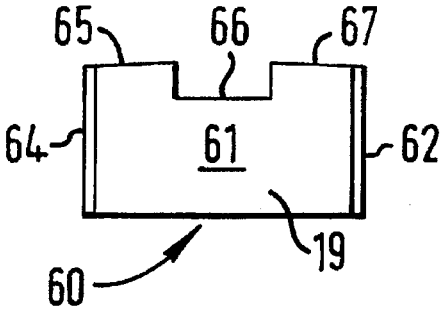
FIG. 3D is a front view of the insert of FIG. 3A.
Figure 3E:
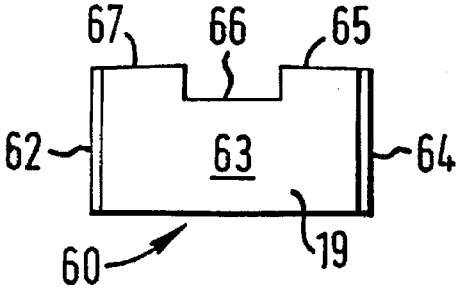
FIG. 3E is a rear view of the insert of FIG. 3A.

FIG. 3A shows an insert 60 according to the present which has a body 19; four sides 61, 62, 63, 64; top milling surfaces 65, 66, and 67; and a plurality of chipbreaking indentations 68 with ridges 69 therebetween. The two sides of the insert 60, one shown in FIG. 3A, look the same.

Figure 4A:
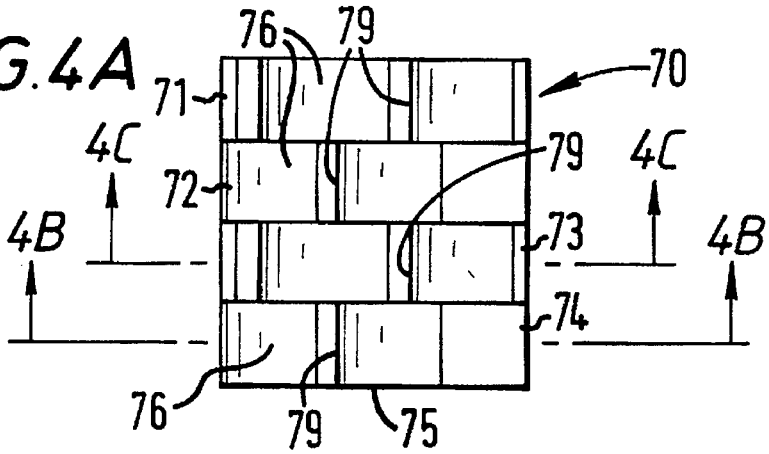
FIG. 4A is a top view of a wellbore milling insert.
Figure 4B:
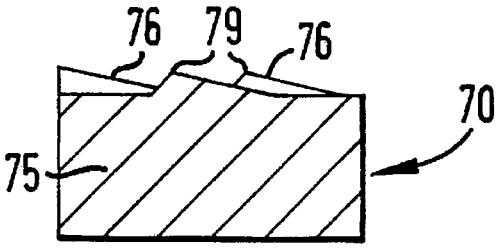
FIG. 4B is a cross-sectional view along line 4B—4B of FIG. 4A.
Figure 4C:
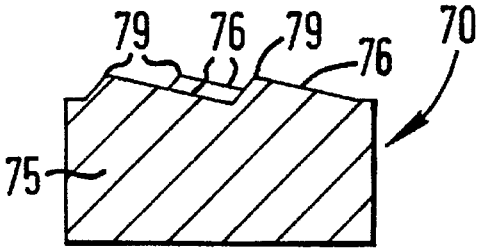
FIG. 4C is a cross-sectional view along line 4C—4C of FIG. 4A.

FIGS. 4A–4C shows an insert 70 with a four sides body 75 with a plurality of top ramps 76 in rows 71, 72, 73, and 74. Peaks 79 of ramps in one row are offset from those in another row.

FIGS. 5A and 5B show inserts 80 and 81 designed by Mr. Robert Taylor and co-owned with the present invention. The insert 80 has a plurality of criss-crossing ridges 82, 83 between which are formed chipbreakers 84. The insert 81 has a plurality of criss-crossing ridges 85, 86 between which are formed chipbreakers 87. As shown in FIG. 5B the insert 81 cuts a casing 88 to form three cuttings 89.

Figure 6A:
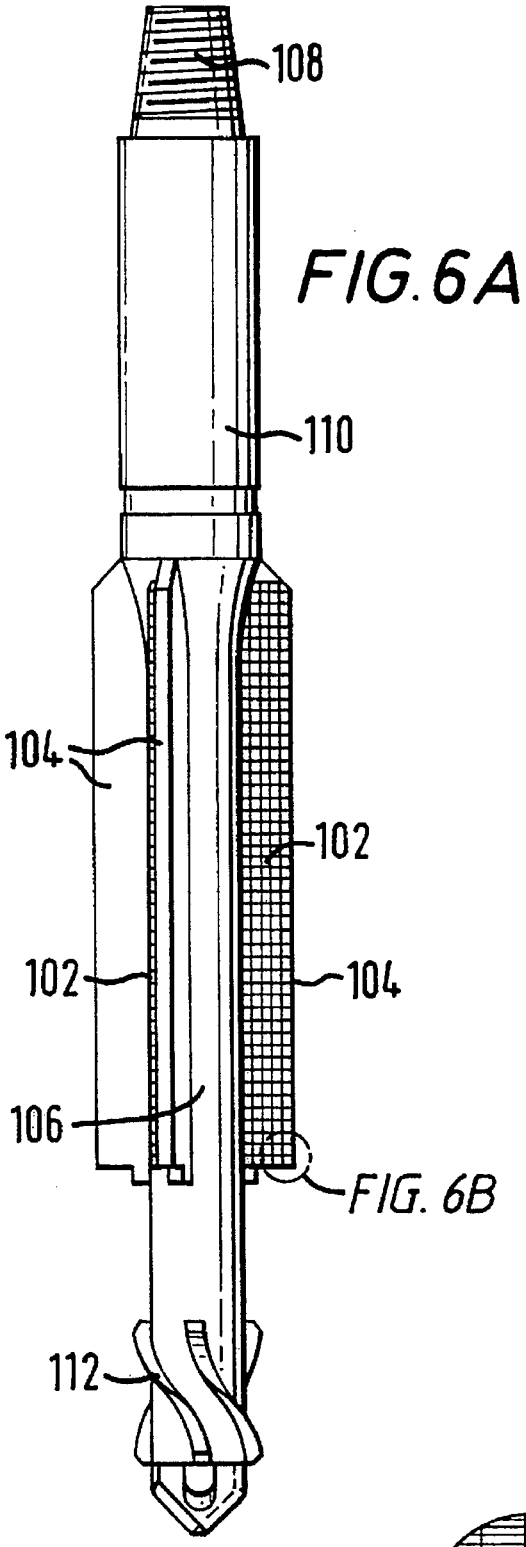
FIG. 6A shows a wellbore milling tool with inserts according to the present invention.
Figure 6B:
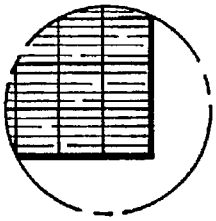
FIG. 6B shows an enlarged portion of the tool of FIG. 6A.

FIG. 6A and 6B show a pilot mill 110 according to the present invention which is like a prior art A-1 TDS Pilot Mill; but with inserts 102 according to the present invention (like any insert described and/or claimed herein) on blades 104 on a mill body 106 with an upper threaded end 108 and a lower pilot mill end 112.

Figure 7:
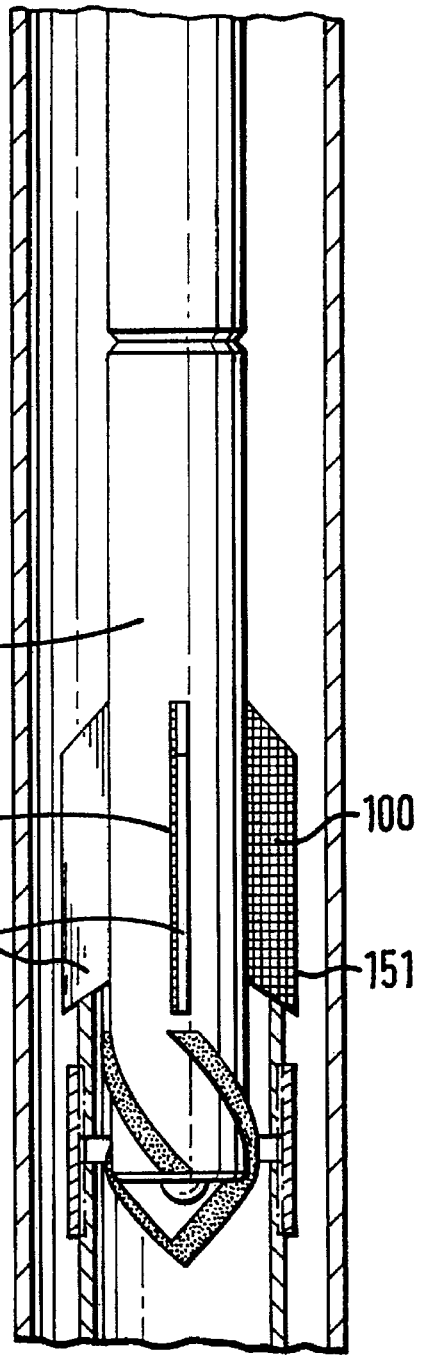
FIG. 7 shows a wellbore milling tool with inserts according to the present invention.

FIG. 7 shows a pilot mill 150 according to the present invention (e.g. similar to that as referred to in U.S. Pat. No. 4,984,488) with inserts 100 according to the present invention (like any insert described and/or claimed herein) on blades 151 thereof. Such inserts may also be used on the bottom ends of the mills shown in FIG. 6A and in FIG. 7.

Filed on even date herewith and co-owned with the present invention are the applications entitled "Section Milling" Ser. No. 08/532,473 filed Sep. 22, 1995 naming Hutchinson as inventor and entitled "Wellbore Sidetracking Methods And Apparatuses" Ser. No. 08/532,180 filed Sep. 22, 1995 naming Schnitker et al as inventors which are both incorporated fully herein for all purposes.

Figure 2B:
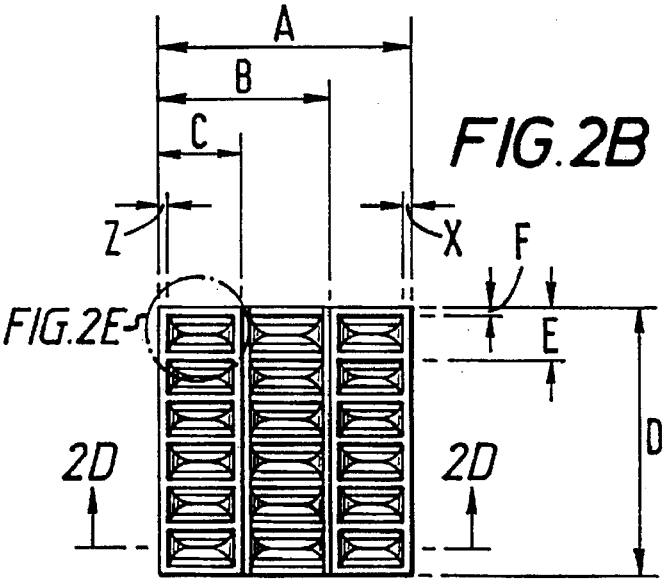
FIG. 2B is a top view of the insert of FIG. 2A (the bottom view is a plain square)
Figure 2E:
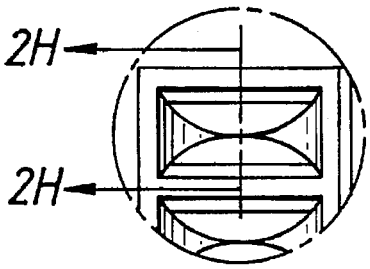
FIG. 2E is an enlargement of a portion of the insert shown in FIG. 2B.

FIG. 8 shows an insert 200 according to the present invention with a base 205 and an upper milling surface that has an array of chipbreaker indentations 202 (like the array in FIG. 2B; like the indentations in FIGS. 1A and 1C). The base 205 when viewed from below is like the top view of FIG. 8, but without any indentations.

FIG. 9 shows an insert 250 according to the present invention with a circular base 255 and three top milling surfaces 256, 257, and 258. The milling surfaces each are covered with chipbreaker indentations 252 separated by ridges 259.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A cutting insert for a tool for wellbore milling operations, the cutting insert comprising a body having a top, a bottom, and a rectangular base, and a plurality of cutting surfaces on the top of the body, at least one of the cutting surfaces at a different height above the base than the other cutting surfaces, each cutting surface defined by linear boundaries extending from a first edge of the cutting insert to a second edge of the cutting insert, and the linear boundaries parallel to each other, the plurality of cutting surfaces comprising three cutting surfaces including a first side cutting surface, a second middle cutting surface, and a third side cutting surface with the second middle cutting surface disposed between the first side cutting surface and the third side cutting surface, the second middle cutting surface is at a height above the rectangular base which is greater than a height above the rectangular base of the first side cutting surface, and the second middle cutting surface is at a height above the rectangular base greater than a height above the rectangular base of the third side cutting surface.

2. The cutting insert of claim 1 wherein the second middle cutting surface is between about 0.03" and about 0.09" higher above the rectangular base than the first side cutting surface and the third side cutting surface.

3. A cutting insert for a tool for wellbore milling operations, the cutting insert comprising a body having a top, a bottom, and a rectangular base, and a plurality of cutting surfaces on the top of the body, at least one of the cutting surfaces at a different height above the base than the other cutting surfaces, each cutting surface defined by linear boundaries extending from a first edge of the cutting insert to a second edge of the cutting insert, and the linear boundaries parallel to each other, the plurality of cutting surfaces comprising three cutting surfaces including a first side cutting surface, a second middle cutting surface, and a third side cutting surface with the second middle cutting surface disposed between the first side cutting surface and the third side cutting surface, the second middle cutting surface is at a height above the rectangular base which is less than a height above the rectangular base of the first side cutting surface, and the second middle cutting surface is at a height above the rectangular base less than a height above the rectangular base of the third side cutting surface.

4. The cutting insert of claim 3 wherein the second middle cutting surface is between about 0.03" and about 0.09" less above the rectangular base than the first side cutting surface and the third side cutting surface.

5. A cutting insert for a tool for wellbore milling operations, the cutting insert comprising a body having a top, a bottom, and a rectangular base, a plurality of cutting surfaces on the body, at least one of the cutting surfaces at a different height above the base than the other cutting surfaces, each cutting surface defined by linear boundaries extending from a first edge of the cutting insert to a second edge of the cutting insert, and the linear boundaries parallel to each other, a plurality of chipbreaking indentations on each cutting surface, and each chipbreaking indentation having an oval shape as viewed from above.

6. A cutting insert for a tool for wellbore milling operations, the cutting insert comprising a body with a top and a bottom and a rectangular base, a plurality of cutting surfaces on the top of the body, at least one of the cutting surfaces at a different height above the top of the rectangular base than the other cutting surfaces, each cutting surface defined by linear boundaries extending from a first edge of the cutting insert to a second edge of the cutting insert, and the linear boundaries parallel to each other, a plurality of chipbreaking indentations on each cutting surface, wherein the plurality of cutting surfaces is three cutting surfaces including a first side cutting surface, a second middle cutting surface, and a third side cutting surface with the second middle cutting surface disposed between the first side cutting surface and the third side cutting surface, wherein the second middle cutting surface is at a first height above the rectangular base which is different than a second height above the rectangular base of the first side cutting surface, a difference in the first height and the second height ranging between about 0.03" and about 0.09", at least one of the cutting surfaces in a first plane at an angle to a second plane in which another of the cutting surfaces is disposed, and the plurality of chipbreaking indentations is a patterned array of rows and columns of indentations covering the entire cutting surfaces.

* * * * *